United States Patent [19]

Uno

[11] Patent Number: 5,046,653

[45] Date of Patent: Sep. 10, 1991

[54] FASTENER DRIVING TOOL

[75] Inventor: Akira Uno, Hitachioota, Japan

[73] Assignee: Hitachi Koki Company, Limited, Japan

[21] Appl. No.: 331,203

[22] Filed: Mar. 31, 1989

[30] Foreign Application Priority Data

Apr. 1, 1988 [JP] Japan ..... 63-81807

[51] Int. Cl.[5] ..... B25C 1/04

[52] U.S. Cl. ..... 227/130; 173/139

[58] Field of Search ..... 227/130; 173/134, 139; 91/399

[56] References Cited

U.S. PATENT DOCUMENTS

| | | | |
|---|---|---|---|
| 2,983,922 | 5/1961 | Juilfs | 91/399 |
| 3,205,787 | 9/1965 | Volkmann | 91/399 |
| 3,605,560 | 9/1971 | Bolte | 91/399 |
| 3,808,620 | 5/1974 | Rothfuss et al. | 91/308 |
| 4,436,237 | 3/1984 | Vornberger et al. | 227/130 |
| 4.480,528 | 11/1984 | Shiroyama | 227/130 X |
| 4,509,669 | 4/1985 | Elliesen | 227/130 |
| 4,549,344 | 10/1985 | Nikolich | 173/139 X |

FOREIGN PATENT DOCUMENTS 3222949 5/1985 Fed. Rep. of Germany .

*Primary Examiner*—Frank T. Yost
*Assistant Examiner*—John M. Husar
*Attorney, Agent, or Firm*—Lowe, Price, LeBlanc & Becker

[57] ABSTRACT

A fastener driving tool such as a pneumatic nailing machine drives a fastener into a workpiece under a fluid pressure supplied into an upper chamber in a cylinder and applied to a piston reciprocally movably disposed in the cylinder. When the fastener being driven is stopped in a power stroke of the piston due to a pressure shortage, the fluid flows from the upper chamber into a lower chamber in the cylinder to make the pressure in the lower chamber equal to or higher than the pressure in the upper chamber. No reactive forces are thus applied by the high pressure in the upper chamber to the fastener driving tool, and the fastener driving tool is prevented from being repelled back when the fastener is stopped. The fastener can then be driven home into the workpiece in successive power strokes of the piston.

20 Claims, 10 Drawing Sheets

FASTENER DRIVING TOOL

BACKGROUND OF THE INVENTION

1. Field of the Invention

The present invention relates to a fastener driving tool, such as a pneumatic nailing machine, for driving a fastener such as a nail, staple, or the like into a workpiece.

2. Description of the Prior Art

Various fastener driving tools are known in the art. Generally, the known fastener driving tools can be divided into two groups. In fastener driving tools of one group, a succession of fasteners are automatically supplied from a magazine and each fastener is driven home into a workpiece by a single power stroke of a fastener driver element. According to the other group of fastener driving tools, one fastener held against a fastener driver element is driven by successive power strokes of a piston connected to the fastener driver element.

FIG. 8 of the accompanying drawings shows a fastener driving tool 1 of the former multifire type. A chain of fasteners 9 is loaded in a magazine 7. When both a switch (A) 2 and a switch 3 are operated, a piston 6 connected to a fastener driver element and slidably fitted in a cylinder 5 is lowered to drive a fastener 9 which has been supplied from the magazine 7 into a position beneath the tip end of the fastener driver element. As the piston 6 is lowered, air in a chamber below the piston 6 is forced to flow into an air chamber 19 through a hole 20 defined in a side wall of the cylinder 5. The cylinder 5 has a smaller hole 21 defined in its side wall and positioned such that the piston 6 is displaced past the smaller hole 21 when the piston 6 is positioned near its lower limit in the cylinder 5. When the piston 6 is moved past the smaller hole 21, compressed air is supplied from a chamber above the piston 6 into the air chamber 19. If either the switch 2 or the switch 3 is released, then compressed air above the piston 6 is discharged from a discharge valve 4, and the piston 6 is elevated back to its upper limit in the cylinder 6 by compressed air stored in the air chamber 19. The fasteners 9 are supplied, one at a time, from the magazine 7 into a drive track 23 below the fastener driver element in response to the operation of the switch 2 and the switch 3.

The conventional fastener driving tool 1 shown in FIG. 8 has the following disadvantages:

(1) While fastener driving tools are generally portable and should be lightweight and compact, the prior fastener driving tool 1 of FIG. 8 is relatively large in size and requires a large amount of energy for driving home a fastener in a single power stroke of the fastener driving element.

(2) The fastener driving tool, which should be constructed to meet safety requirements, may be dangerous if triggered in error because the amount of energy discharged in a single power stroke of the fastener driving element to drive a fastener is substantial.

(3) If a workpiece into which a fastener is to be driven is too hard for the driving energy to drive the fastener fully into the workpiece, then the fastener being driven is stopped halfway as shown in FIG. 9, and the fastener driving tool 1 is repelled upwards under reactive forces. The repelling action of the fastener driving tool will be described in greater detail with reference to FIG. 9. When the switch 2 and the switch 3 are operated, compressed air flows into the chamber above the piston 6 to lower the piston 6 quickly to drive the fastener 9. If the workpiece is hard enough to resist and stop the fastener 9 halfway in the power stroke of the piston 6, the piston 6 stops its downward motion when the fastener 9 is stopped. However, since compressed air is still supplied to the chamber above the piston 6 and the power stroke of the piston 6 is not yet completed, the fastener driving tool 1 itself is repelled upwards under reactive forces from the compressed air in the chamber above the piston 6.

FIG. 10 shows a fastener driving tool of the second category in which a fastener is driven home by successive power strokes of a fastener driver element under the energy of compressed air. In operation, a fastener 9 is placed in a guide 14 in the nosepiece of the fastener driving tool 1. The fastener driving tool is held by hand and the nosepiece is held against a workpiece, whereupon a piston 6 is vertically moved reciprocally to drive the fastener in successive power strokes. Each power stroke is small, e.g., about 3 mm, and hence any repelling motion of the fastener driving tool is small. The guide 14 is vertically movably mounted in the nosepiece so that the fastener 9 will not be dislodged out of the guide 14 even when the fastener driving tool 1 is repelled upwards away from the workpiece.

The fastener driving tool of this type is free of some of the problems of the fastener driving tool shown in FIGS. 8 and 9, but still suffers the following shortcomings:

(1) Since the successive power strokes of the fastener driving tool produce continued vibration during its operation, the hand of the operator will be fatigued if the fastener driving tool is continuously used over a long period of time.

(2) The efficiency is low because a fastener has to be manually placed in the guide 14 each time it is to be driven.

(3) When a fastener is manually placed in the guide 14, inasmuch as the operator's fingers are positioned closely to the fastener driver element, they may get injured if the fastener driving tool is erroneously triggered into operation.

SUMMARY OF THE INVENTION

In view of the aforesaid defects of the conventional fastener driving tools, it is an object of the present invention to provide a fastener driving tool which is safe, efficient, lightweight, and compact.

According to the present invention, there is provided a fastener driving tool for driving a fastener into a workpiece under the pressure of a fluid under pressure, comprising a cylinder, a piston reciprocally movably disposed in the cylinder and dividing an interior space of the cylinder into first and second chambers, repetitive valve means for repeating reciprocating movement of the piston, driver element means connected to the piston for driving the fastener in successive power strokes of the piston, and means for supplying the fluid under pressure into the first chamber to move the piston in a power stroke, the cylinder having communication means for providing fluid communication between the first and second chambers when the piston reaches a predetermined position in a power stroke, to allow the fluid under pressure to flow from the first chamber into the second chamber for making the pressure of the fluid in the second chamber substantially equal to or higher than the pressure of the fluid in the first chamber before the piston reaches a limit in the power stroke, the communication means having a cross-sectional area which is at least 8/1000 of the value of the volume of the second chamber and an air chamber intermediate said first and second chambers when the piston reaches the predetermined position.

The communication means comprises at least one hole defined radially through a side wall of the cylinder, or at least one groove defined axially in a side wall of the cylinder.

The repetitive valve means comprises a valve movable in response to an increase in the pressure of the fluid in the second chamber for discharging the fluid from the first cylinder.

When the fastener being driven into a workpiece is stopped in the power stroke due to a pressure shortage, the fluid under pressure flows from the first chamber into the second chamber to substantially equalize the pressures in the first and second chambers or make the pressure in the second chamber higher than the pressure in the first chamber. Therefore, no reactive forces which would otherwise result from a higher pressure in the first chamber are applied, and hence the fastener driving tool is prevented from being repelled upwards when the fastener being driven is stopped. The fastener is then driven home into the workpiece in repeating the power stroke of the piston.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
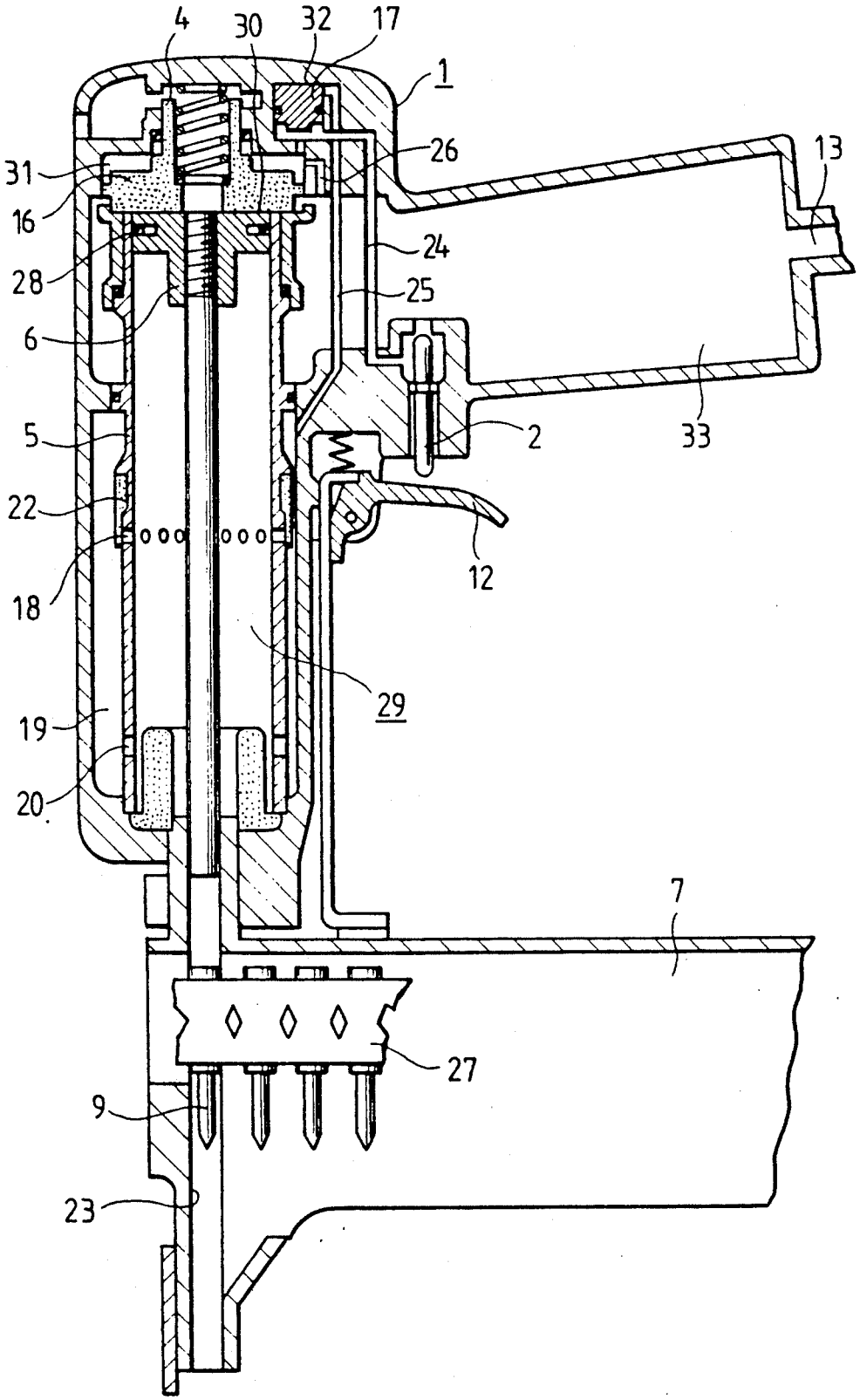
FIG. 1 is a cross-sectional view of a fastener driving tool according to a preferred embodiment of the present invention.

Like or corresponding parts are denoted by like or corresponding reference numerals throughout views.

Figure 2:
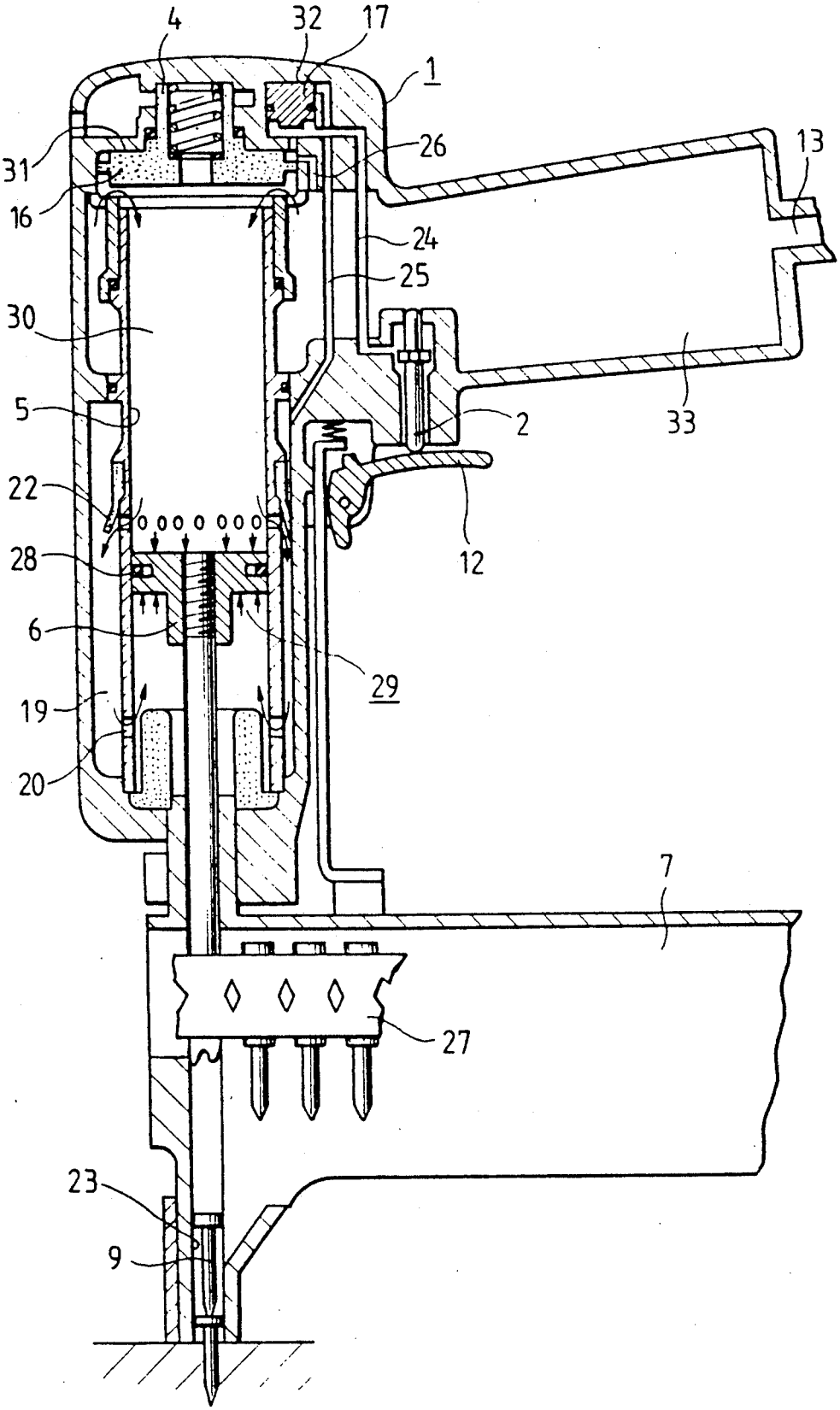
FIGS. 2 and 3 are cross-sectional views showing the manner in which the fastener driving tool of FIG. 1 operates.
Figure 3:
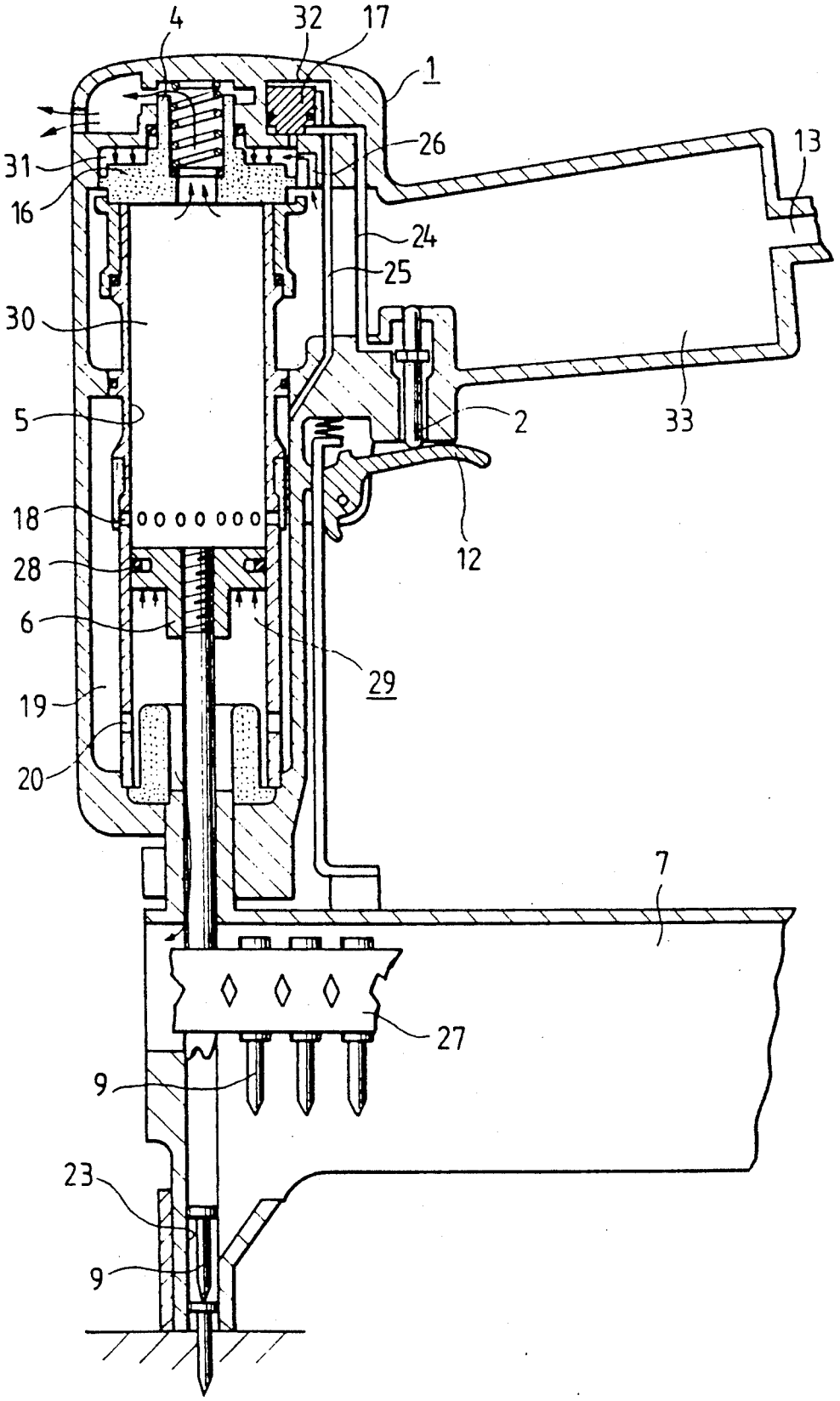

FIG. 1 shows a fastener driving tool 1, typically a pneumatic nailing machine, having a hollow cylinder 5 with a seal 6 vertically slidably disposed therein. A piston 28 is fitted in an annular groove defined in the outer peripheral surface of the piston 6 to provide sealing between the cylinder 5 and the piston 6 sliding therein. The fastener driving tool 1 has a main valve chamber 31 defined in the upper end of a tool casing and housing a main valve 16 disposed in the main valve chamber 31 and positioned on the upper end of the cylinder 5. When the main valve 16 is lifted, as shown in FIG. 2, the upper end of the cylinder 5 is opened, a discharge valve 4 in the main valve 16 is closed, and an upper chamber 30 defined in the cylinder 5 above the piston 6 communicates with an air chamber 33 defined in the grip of the fastener driving tool 1 and connected to a source of compressed air (not shown) via a passage 13. When the main valve 16 is lowered, as shown in FIG. 3, the upper end of the cylinder 5 is closed, the discharge valve 4 is opened, and the upper chamber 30 communicates with the atmosphere through the discharge valve 4. A repetitive valve chamber 32 defined in the tool casing near the main valve 16 and houses a repetitive valve 17 therein for repeating reciprocating movement of the piston 6. One side of the repetitive valve 17 (i.e., the lower portion of the repetitive valve chamber 32) communicates with a switch 2 in the grip through a passage 24 and also with the air chamber 33 through a passage 26.

A lower chamber 29 defined in the cylinder 5 below the piston 6 communicates with an air chamber 19 through holes 20 defined in a side wall of the cylinder 5. The air chamber 19 is also held in communication with the other side of repetitive valve 17 (i.e., the upper portion of the repetitive valve chamber 32) through a passage 25. The side wall of the cylinder 5 also has communication holes 18 defined radially therethrough and through which the upper and lower chambers 30, 29 can communicate with each other through a check valve 22 mounted on the outer surface of the side wall of the cylinder 5 after the piston 6 has been lowered past the communication holes 18. The communication holes 18 serve to prevent the fastener driving tool 1 from being repelled upwards when a fastener 9 such as a nail is stopped while being driven into a workpiece owing to a shortage of driving energy. The cross-sectional area and position of the communication holes 18 are selected such that, before the fastener 9 is stopped, compressed air in the upper chamber 30 flows through the communication holes 18 and the air chamber 19 into the lower chamber 29 to equalize the pressure $P_2$ in the lower chamber 29 with the pressure $P_1$ in the upper chamber 30. It was confirmed through experimentation that the total cross-sectional area S ($cm^3$) of the passages defined in the communication holes 18 needs to be about 8/1000 or more of the value of the total volume V ($cm^3$) of the lower chamber 29 and the air chamber 19.

Figure 4:
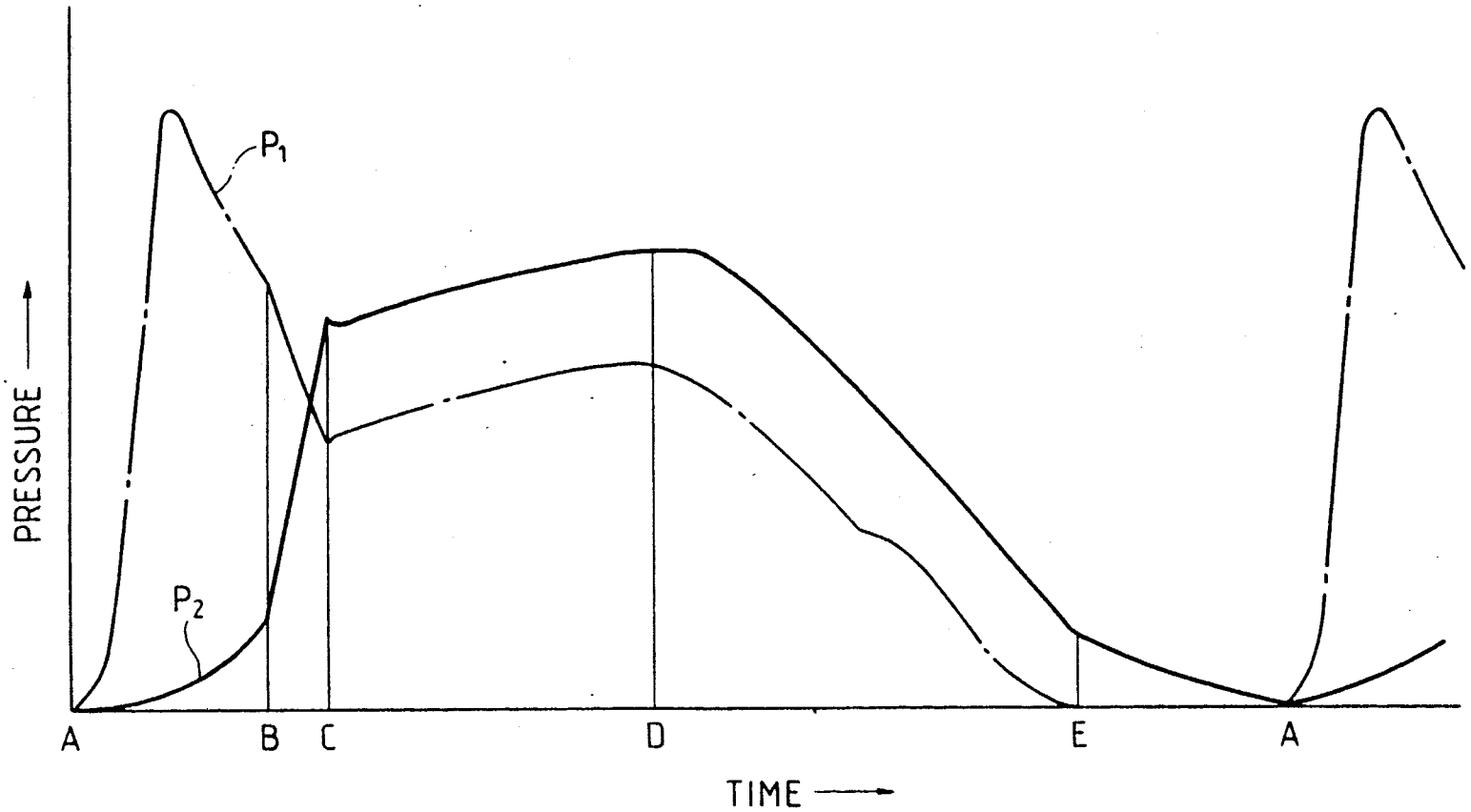
FIG. 4 is a graph showing how the pressures in chambers above and below a piston vary with time during operation of the fastener driving tool of FIG. 1.

Operation of the fastener driving tool 1 will be described below with reference to FIGS. 2, 3, and 4. FIG. 4 shows the pressure $P_1$ in the upper chamber 30 and the pressure $P_2$ in the lower chamber 29 as they vary with time during operation. As shown in FIGS. 2 and 4, when a trigger 12 is pulled, compressed air in the main valve chamber 31 is discharged through the passage 24 from the switch 2, thus allowing the main valve 16 to rise. The discharge valve 4 is closed and the upper chamber 30 communicates with the air chamber 33, whereupon compressed air from the air chamber 33 is admitted into the upper chamber 30 (at a point A in FIG. 4).

The piston 6 is now lowered quickly under the pressure of the compressed air supplied into the upper chamber 30. At this time, the energy of the compressed air in the upper chamber 30 is transmitted as kinetic energy of the piston 6. When the piston 6 descends past the communication holes 18, some of the compressed air from the upper chamber 30 flows through the communication holes 18 into the lower chamber 29, thus developing a quick increase in the pressure $P_2$ in the lower chamber 29 (at a point B in FIG. 4).

A succession of fasteners 9 are interconnected by a band 27 and stored in a magazine 7. One of the fasteners 9, at a time, is supplied into a drive track 23 below a fastener driver element connected to and extending from the piston 6. The fastener 9 is driven into a workpiece by the fastener driver element as the piston 6 is lowered. On its way into the workpiece, the fastener 9 is stopped since the driving energy is not large enough to drive the fastener 9 home into the workpiece. At this time, the pressure $P_2$ in the lower chamber 29 is substantially the same as or higher than the pressure $P_1$ in the upper chamber 30. Therefore, no reactive forces which would tend to repel the fastener driving tool 1 upwards are applied to the fastener driving tool 1 by the compressed air in the upper chamber 30, and thus the fastener driving tool 1 is not repelled back upwards and the piston 6 is stopped in its power stroke (between points B and C in FIG. 4). Consequently, the fastener driving tool 1 is highly safe in operation.

As shown in FIGS. 3 and 4, since the upper portion of the repetitive valve chamber 32 communicates with the lower chamber 29 through the passage 25, when the pressure $P_2$ in the lower chamber 29 is increased, the repetitive valve 17 is lowered to close the passage 24. Therefore, the pressure in the main valve chamber 31 is increased by compressed air which flows from the passage 26, thereby lowering the main valve 16. The downward movement of the main valve 16 closes the upper end of the cylinder 5 and opens the discharge valve 4, whereupon the compressed air in the upper chamber 30 is discharged out through the discharge valve 4 (at a point D in FIG. 4). The piston 6 is then elevated back to its upper limit in the cylinder 5 under the pressure of the compressed air in the lower chamber 29 (at a point E in FIG. 4). Upon the ascent of the piston 6, the ower chamber 29 is expanded and the pressure $P_2$ therein is lowered. The pressure $P_2$ is further lowered since the air is also discharged from the lower chamber 29 through a gap between the piston 6 and the drive track 23. Inasmuch as the pressure in the upper portion of the repetitive valve chamber 32 is also reduced, the repetitive valve 17 is lifted under the pressure in the main valve chamber 31 to open the passage 24 which then permits the compressed air to be discharged from the main valve chamber 31 through the switch 2. When the compressed air is discharged from the main valve chamber 31, the main valve 16 is elevated again to start driving the fastener 9 again. The above driving operation is therefore repeated to drive the fastener 9 fully into the workpiece.

When the trigger 12 is released to close the switch 2, the compressed air in the air chamber 33 flows through the passage 24 into the main valve chamber 31. The main valve 16 is lowered to stop the repetitive driving operation.

The fastener driving tool 1 is prevented from being repelled when a fastener being driven into the workpiece is stopped halfway in the power stroke of the piston 6, as described above. Therefore, the upper end of the fastener thus stopped remains positioned in the drive track 23. The remaining fastener can then be further driven by automatically repeating the power stroke of the piston 6, i.e., in successive power strokes of the piston 6 without being dislodged from the drive track 23. Since the fastener driving tool 1 can thus drive a fastener in successive power strokes, it can be more lightweight and compact than those fastener driving tools which drive a fastener in a single power stroke. The fastener driving tool 1 is highly efficient since it can automatically drive a succession of fasteners.

Figure 5:
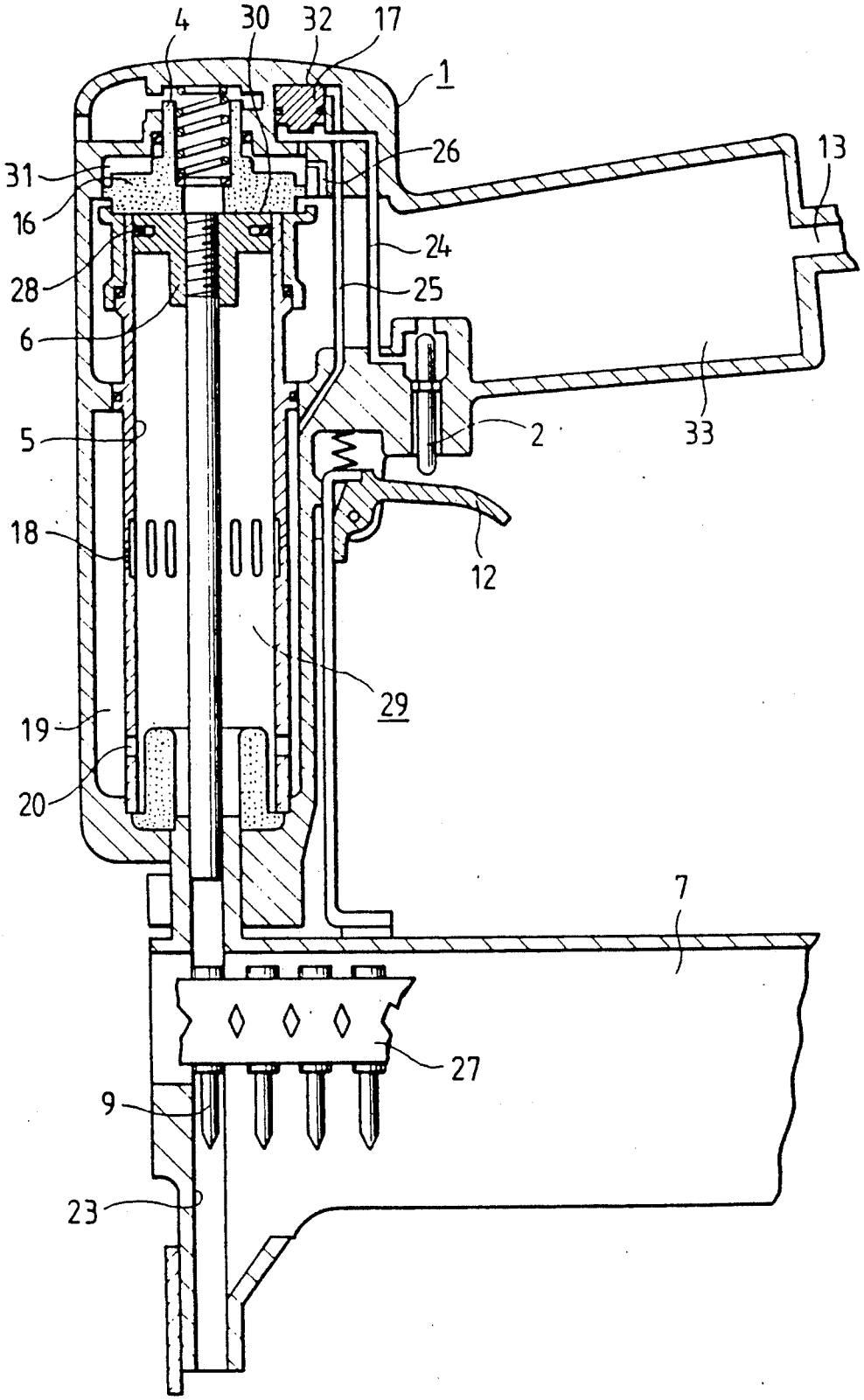
FIGS. 5, 6, and 7 are cross-sectional views of fastener driving tools according to other embodiments of the present invention.

FIG. 5 shows a modified fastener driving tool 1 in which the upper and lower chambers 30, 29 can be brought into communication with each other through a plurality of axially elongate grooves 18 defined in the inner surface of the side wall of the cylinder 5.

Figure 6:
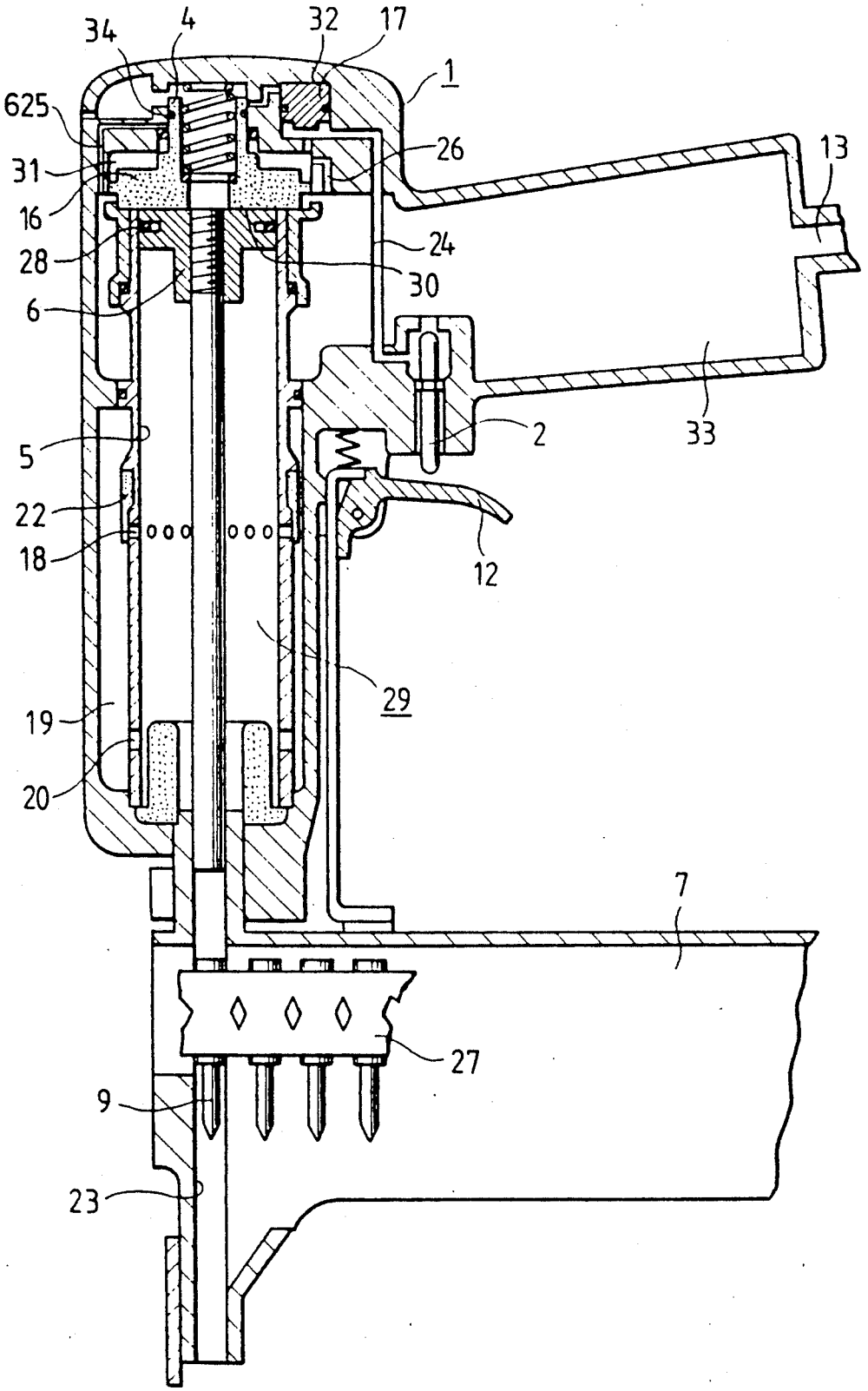

FIG. 6 illustrates another modification in which the air chamber 33 and the upper portion of the repetitive valve chamber 32 are held in communication with each other through a passage 625 extending across a main valve member 34 of the main valve 16. According to this modification, the repetitive valve 17 can be operated in response to operation of the main valve 16, rather than a change in the pressure in the lower chamber 29 as is the case with the embodiment of FIGS. 1 through 3.

Figure 7:
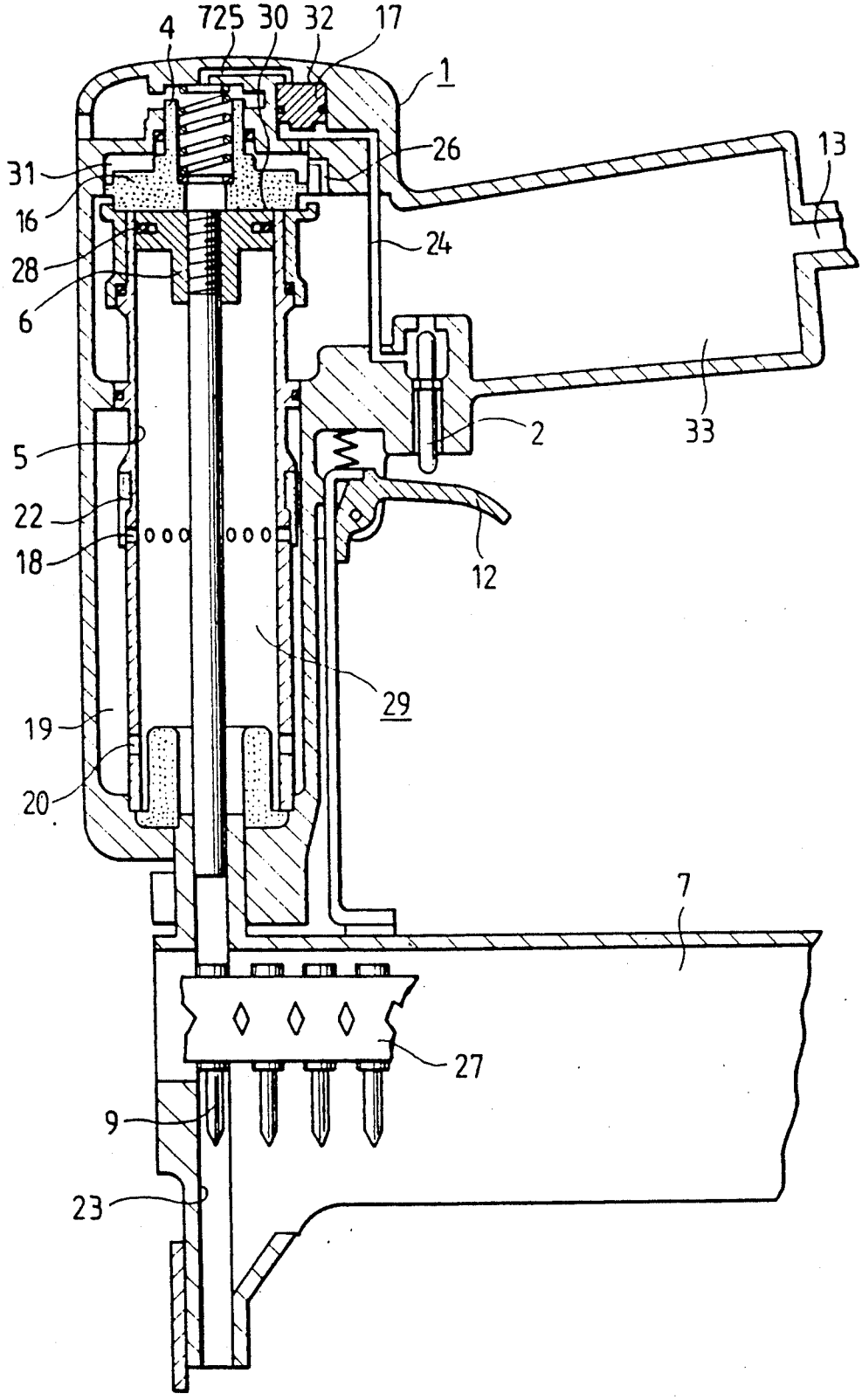
Figure 8:
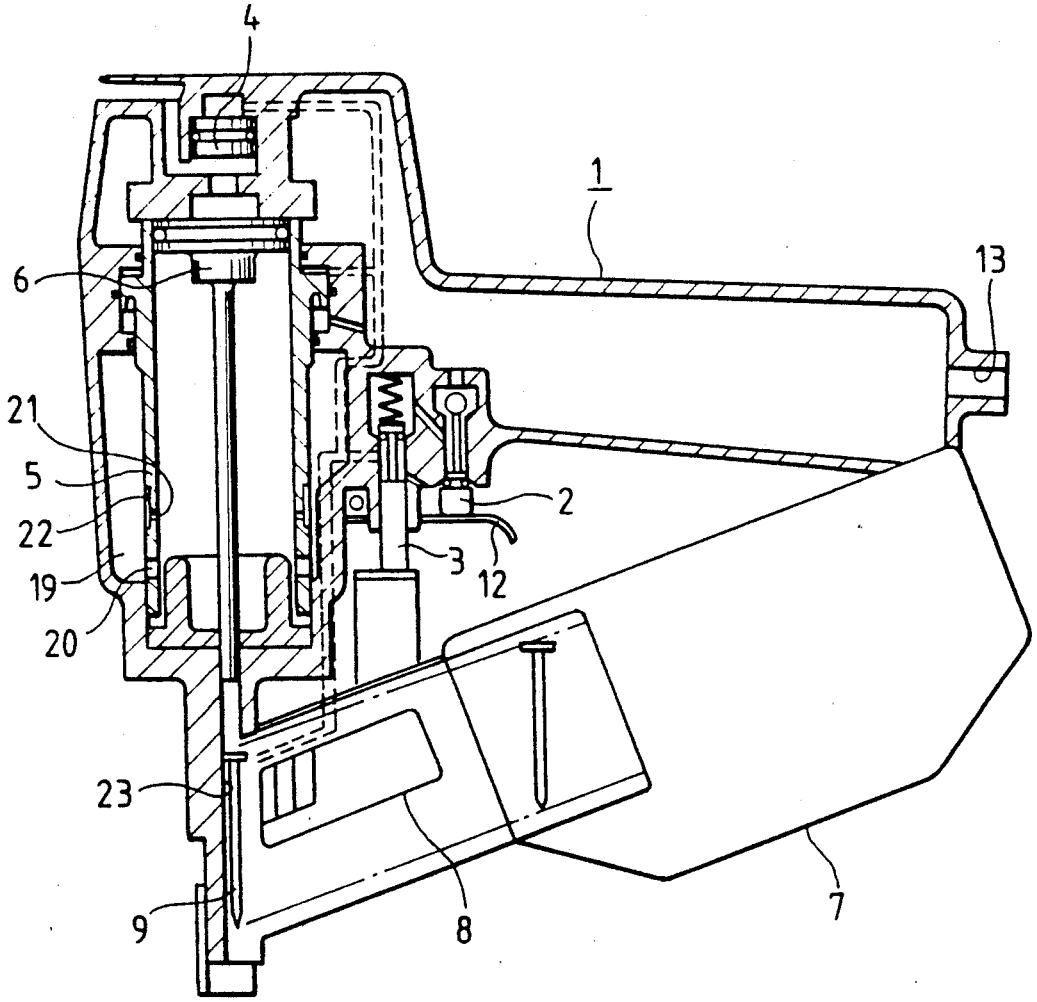
FIG. 8 PRIOR ART
FIG. 8 is a cross-sectional view of a conventional automatic fastener driving tool.
Figure 9:
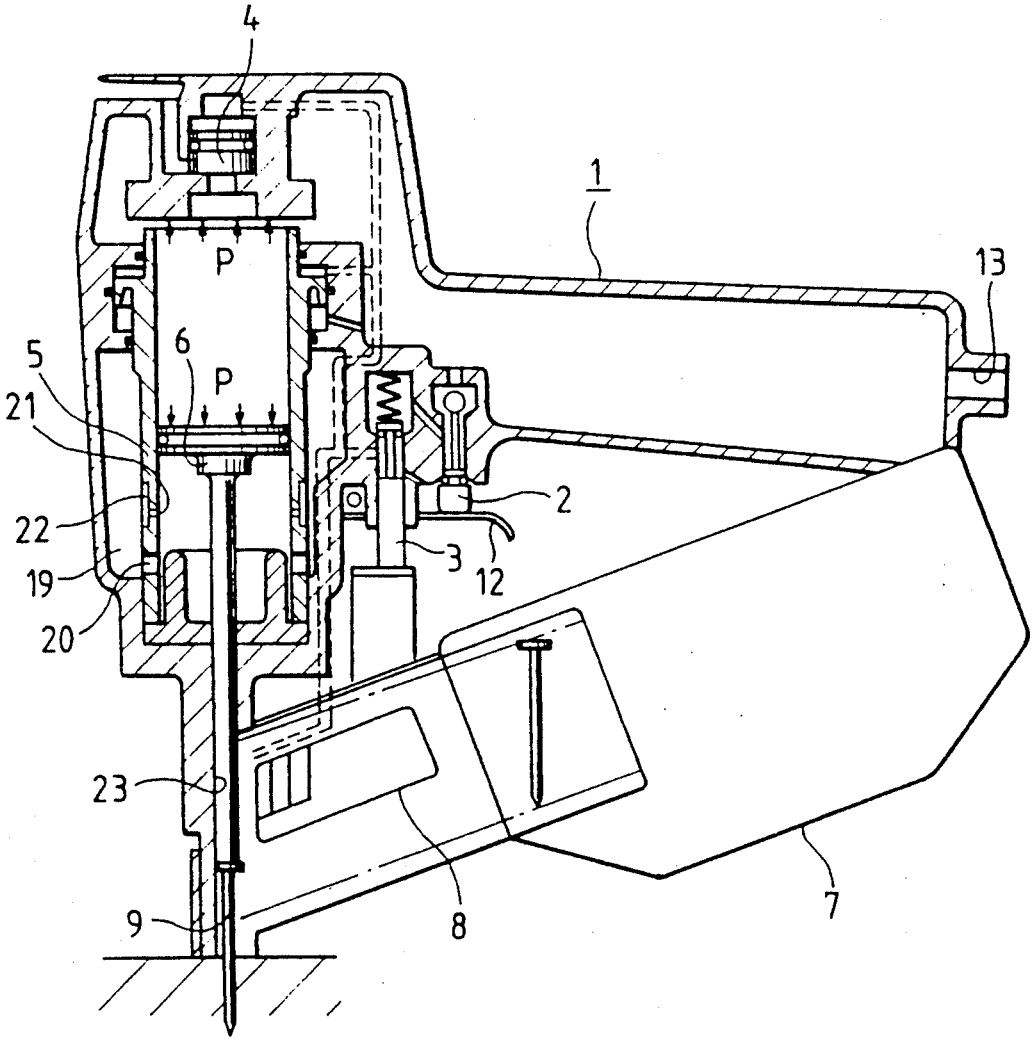
FIG. 9 PRIOR ART
FIG. 9 is a cross-sectional view illustrating the manner in which a fastener is driven by the automatic fastener driving tool of FIG. 8.
Figure 10:
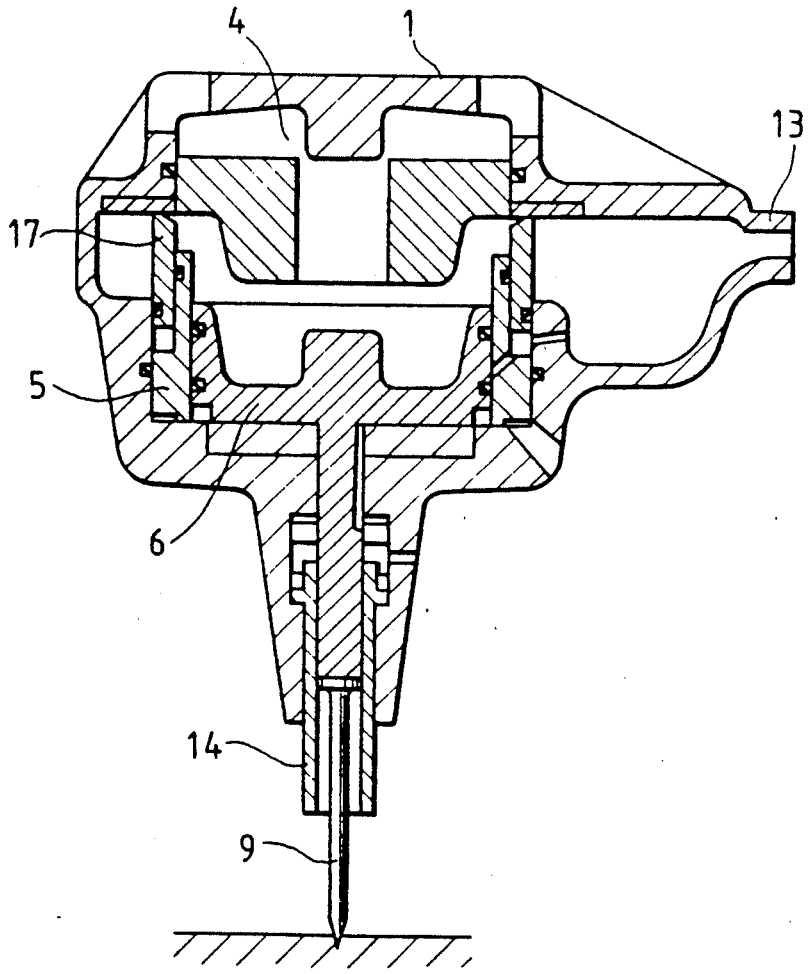
FIG. 10 PRIOR ART
FIG. 10 is a cross-sectional view of another conventional fastener driving tool.

According to still another modified fastener driving tool 1 shown in FIG. 7, the upper chamber 30 and the repetitive valve chamber 32 communicate with each other through a passage 725 to operate the repetitive valve 17 in response to a change in the pressure in the upper chamber 30.

In the above embodiment and modifications, compressed air is admitted into and discharged from the upper chamber 30 in response to operation of the main valve 16. However, compressed air may be supplied and discharged in response to movement of the cylinder 5 or a cylinder sleeve disposed around the cylinder 5.

Although certain preferred embodiments have been shown and described, it should be understood that many changes and modifications may be made therein without departing from the scope of the appended claims.

What is claimed is:

1. A fastener driving tool for driving a fastener into a workplace under the pressure of a fluid, comprising:

a cylinder;

a piston reciprocally movably disposed in said cylinder and dividing an interior space of said cylinder into first and second chambers;

repetitive valve means operable for repeating reciprocating movement of said piston;

driver element means connected to said piston door driving the fastener in successive power strokes of said piston; and main valve means for supplying the fluid under pressure into said first chamber to move said piston in a power stroke, wherein said cylinder comprises communication means for providing fluid communication between said first and second chambers through an intermediate fluid chamber when said piston reaches a first predetermined position in a power stroke, to allow the fluid under pressure to flow from said first chamber into said second chamber for making the pressure of the fluid in said second chamber substantially equal to or higher than the pressure of the fluid in said first chamber before said piston reaches a second predetermined position in the power stroke, wherein said first predetermined position of the piston corresponds to a maximum value of the total volume of said second chamber and said intermediate chamber and said second predetermined position of the piston corresponds to said fastener coming to a stop in said power stroke of the piston, and said communication means has a cross-sectional area which is at least 8/1000 of the maximum value of the total volume of said second chamber and said intermediate chamber (said area and volume being expressed in consistent units) when said piston reaches said predetermined position.

2. A fastener driving tool according to claim 1, wherein:

said communication means comrpises at least one hole defined radially through a side wall of said cylinder.

3. A fastener driving tool according to claim 1, wherein:

said communication means comprises at least one groove defined axially in a side wall of said cylinder.

4. A fastener driving tool according to claim 1, wherein:

said repetitive valve means comprises a valve movable in a repetitive valve chamber in response to an increase in the pressure of the fluid in said second chamber, for thereby discharging fluid from said first cylinder.

5. A fastener driving tool according to claim 4, wherein:

said main valve means comprises a main valve member, chamber through a passage extending across said main valve member, and said repetitive valve means operates in response to an operation of said main valve member.

6. A fastener driving tool according to claim 4, wherein:

said first chamber communicates with said repetitive valve chamber, whereby said repetitive valve means operates in response to a pressure change in said first chamber.

7. A fastener driving tool according to claim 4, wherein:

said communication means comprises at least one hole defined radially through a side wall of said cylinder.

8. A fastener driving tool according to claim 5, wherein:

said communication means comprises at least one hole defined radially through a side wall of said cylinder.

9. A fastener driving tool according to claim 6, wherein:

said communication means comprises at least one hole defined radially through a side wall of said cylinder.

10. A fastener driving tool according to claim 4, wherein:

said communication means comprises at least one groove defined axially in a side wall of said cylinder.

11. A fastener driving tool according to claim 5, wherein:

said communication means comprises at least one groove defined axially in a side wall of said cylinder.

12. A fastener driving tool according to claim 6, wherein:

said communication means comprises at least one groove defined axially in a side wall of said cylinder.

13. A fastener driving tool for driving a fastener into a workpiece under the pressure of a fluid, comprising:

a cylinder;

a piston reciprocally movably disposed in said cylinder and dividing an interior space of said cylinder into first and second chambers;

repetitive valve means operable for repeating recirpocating movement of said piston;

driving element means connected to said piston for driving the fastener in successive power strokes of said piston; and main valve means for supplying the fluid under pressure into said first chamber to move said piston in a power stroke, wherein said cylinder comprises communication means for providing fluid communication between said first and second chambers through an intermediate fluid chamber when said piston reaches a first predetermined position in a power stroke, to allow the fluid under pressure to flow from said first chamber into said second chamber for making the pressure of the fluid in said second chamber substantially equal to or higher than the pressure of the fluid in said first chamber before said piston reaches a second predetermined position in the power stroke, and said first predetermined position of the piston corresponds to a maximum value of the total volume of said second chamber and said intermediate chamber and said secon predetermined position of the piston corresponds to said fastener coming to a stop in said power stroke of the piston.

14. A fastener driving tool according to claim 13, wherein:

said communication means comprises at least one hole defined radially through a side wall of said cylinder.

15. A fastener driving tool according to claim 13, wherein:

said communication means comprises at least one internal groove defined axially in a side wall of said cylinder.

16. A fastener driving tool according to claim 13, wherein:

said repetitive valve means comprises a valve movable in a repetitive valve chamber in response to an increase in the pressure of the fluid in said second chamber, for thereby discharging fluid from said first cylinder.

17. A fastener driving tool according to claim 16, wherein:

said main valve means comprises a main valve member, said repetitive valve chamber communicates with said second chamber through a passage extending across said main valve member, and said repetitive valve means operates in response to an operation of said main valve member.

18. A fastener driving tool according to claim 16, wherein:

said first chamber communicates with said repetitive valve chamber, whereby said repetitive valve means operates in response to a pressure change in said first chamber.

19. A fastener driving tool according to claim 16, wherein:

said communication means comprises at least one hole defined radially through a side wall of said cylinder.

20. A fastener driving tool according to claim 16, wherein:

said communication means comprises at least one internal groove defined axially in a side wall of said cylinder.

* * * * *